United States Patent [19]

Bogner

[11] Patent Number: 4,622,075

[45] Date of Patent: Nov. 11, 1986

[54] METAL CLEANING

[75] Inventor: Ben R. Bogner, Wheaton, Ill.

[73] Assignee: QO Chemicals, Inc., Oak Brook, Ill.

[21] Appl. No.: 797,158

[22] Filed: Nov. 12, 1985

Related U.S. Application Data

[63] Continuation of Ser. No. 661,113, Oct. 15, 1984, abandoned.

[51] Int. Cl.[4] ..... B08B 7/00

[52] U.S. Cl. ..... 134/22.14; 156/344; 427/155; 427/156; 134/4

[58] Field of Search ..... 134/4, 22.14; 156/344; 427/155, 156

[56] References Cited

U.S. PATENT DOCUMENTS

| | | | |
|---|---|---|---|
| 4,200,671 | 4/1980 | Krajewski et al. | 134/4 |
| 4,325,744 | 4/1982 | Panayappan et al. | 134/3 |
| 4,368,082 | 1/1983 | Poels | 134/4 |
| 4,424,079 | 1/1984 | Barabas | 427/444 |
| 4,451,296 | 5/1984 | Barabas | 134/4 |

*Primary Examiner*—Joseph L. Schofer
*Assistant Examiner*—J. M. Reddick
*Attorney, Agent, or Firm*—Neuman, Williams, Anderson & Olson

[57] ABSTRACT

A process for cleaning a metal, plastic or wood surface on which there is a residue resulting from contact with a cured resin which comprises applying to said surface a solution of a copolymer of N-vinyl-2-pyrrolidone and maleic acid, drying said solution of N-vinyl-2-pyrrolidone and maleic acid to form a film, and separating said film from the metal surface.

6 Claims, No Drawings

METAL CLEANING

This is a continuation of application Ser. No. 661,113 filed Oct. 15, 1984, now abandoned, the text of which is hereby incorporated by reference.

This invention relates to the cleaning of metals.

As is known, when molten metal is poured into a shaping cavity and permitted to cool, the metal assumes the shape of the cavity as defined by the wall surfaces of the cavity as well as by projecting surfaces extending into or suspended within the cavity. In metal foundries, sand bound by a cured resin to form rigid sand molds or sand cores are used to produce metal products of various shapes. Such foundry molds and cores are, in turn, formed by other "molding" elements which, in the foundry art, are called "patterns" and "core boxes", respectively. Even though the "core box" term is used, the core box is, of course, a pattern or shaping element. Thus, in this application when the term "pattern" is used it is intended to refer to both elements for shaping sand molds as well as to elements for shaping sand cores.

The pattern elements, namely patterns and core boxes, are generally manufactured from metals, thermosetting plastics and wood and typically are formed from iron, steel, aluminum, polyurethane, epoxy alloys, kirksite alloy, stainless steel, herbwoods and the like. It is these pattern elements, which repeatedly come into contact with cured resin binder materials, which benefit from the process of the present invention.

In the metal foundry art sand molds and sand cores are formed by introducing into an appropriate pattern element a mixture of sand and a resinous binder which, upon curing, forms a rigid sand shape which can then be used to receive and shape molten metal. Various resinous binder materials are used to form the sand shapes with the curing or hardening of the resins being accomplished by the use of curing catalysts, e.g., acid catalysts with acid curable binders or amine catalysts with amine curable binders. Perhaps furan and phenolic-urethane type binders are the most widely used in the foundry art to form rigid sand shapes, although numerous other resinous binder types do find use. Representative of resinous binders used to form foundry sand cores and molds are furan no-bake binders, phenolic no-bake binders, phenolic urethane-amine binders, phenolic hot box binders, furan hot box binders, furan-sulfur dioxide binders, acrylic-sulfur dioxide binders, epoxy acrylic-sulfur dioxide binders, alkyd oil binders and the like.

As a result of repeated use of the pattern elements, a coating or residue builds up on the surfaces thereof. It is speculated that this coating or residue comprises a reaction product of the resinous binder and catalyst used for curing the resin and it may include sand contaminants and reaction products formed by the curing catalysts reacting with the pattern surfaces. In any event, build-up of such a residue on the surface of the pattern elements is a problem in the metal foundry art necessitating that periodically this residue be removed from the pattern elements. Heretofore, a commonly employed method of cleaning the pattern elements involved subjecting the elements to sand blasting. This cleaning method is not completely satisfactory since it is time-consuming and can cause damage to the surface of the metal, plastic or wood pattern if not carefully conducted. High pressure sand blasting presents a potential danger to an operator and this is a further disadvantage, such as the danger of silicosis of the lungs.

It is therefore a principal object of this invention to provide an improved method for cleaning metal surfaces.

Another object of the invention is to provide a simple and effective method for cleaning metal, plastic and wood surfaces on which there is a residue resulting from contact with a cured resin.

A further object of the invention is to provide a method for cleaning metal, plastic or wood surfaces, which method does not involve the use of high temperatures, high pressure equipment, strongly corrosive cleaners or aggressive solvents.

It has now been found, surprisingly, that the residue deposited on metal, plastic and wood surfaces as a result of contact with a cured resin can be simply and effectively removed by applying thereto a cleaning composition comprising N-vinyl-2-pyrrolidone/maleic acid copolymer. The cleaning composition is preferably applied to the "dirty" metal, plastic or wood surface in the form of a liquid solution by any suitable means, such as by brushing or spraying it thereon or by dipping the dirty surface into the cleaning solution. Water is the preferred solvent, although solvents other than water can be used to form the cleaning solution. Such solvents include, for example, methanol, ethanol, methyl ethyl ketone, butyl acetone, N-methylpyrrolidone, phenoxyethanol, dimethylformamide and the like. The cleaning solution is permitted to dry to a substantially dry film which can be peeled from the treated surface along with the undesired cured resin residue.

Thus, the invention involves a process for cleaning a metal, plastic or wood surface on which there is a residue resulting from contact with a cured resin which comprises applying to said surface a solution of a copolymer of N-vinyl-2-pyrrolidone and maleic acid, drying said solution of N-vinyl-2-pyrrolidone and maleic acid to form a film, and separating said film from the metal surface.

N-vinyl-2-pyrrolidone/maleic acid copolymer in the form of an aqueous solution is commercially available from GAF Corporation, New York, N.Y. under the designation Agent CD 260. U.S. Pat. No. 4,424,079 describes the N-vinyl-2-pyrrolidone/maleic acid copolymer and methods of making it, and the disclosure of that patent is incorporated herein. In U.S. Pat. No. 4,424,079 the N-vinyl-2-pyrrolidone/maleic acid copolymer is disclosed as being useful to remove rust from metal surfaces. The commercial CD 260 N-vinyl-2-pyrrolidone/maleic acid copolymer is promoted by the supplier thereof as having the ability to "auto-release" from various types of surfaces, including thermoplastics such as high/low density polyethylene, polypropylene, cellulose acetate, rigid/plasticized vinyl, cellulose acetate butyrate, nylon, polymethylmethacrylate, polytetrafluoroethylene, polystyrene, polycarbonate, acrylonitrile butadiene-styrene and polyvinyl chloride, and thermosetting materials such as phenol-formaldehyde, melamine-formaldehyde, alpha cellulose phenol-formaldehyde, polyester, epoxy and silicone.

The viscosity of the metal cleaning solution can be adjusted for easy application as desired, as described in U.S. Pat. No. 4,424,079. Generally, an aqueous solution of copolymer having a viscosity within the range of about 2,000 to 75,000 centipoise is convenient for use. The molecular weight of the N-vinyl-2-pyrrolidone/maleic acid copolymer can vary as described in that patent; however, in general, a molecular weight of greater than 15,000 forms better films.

After application, the cleaning solution is dried to form a peelable solid film. Drying can be accomplished at room temperature in periods of from about 30 to 120 minutes or drying can be accelerated by heating, such as by directing warm air thereon, or by forced air connection. Surfactants can be added to improve wetout of the N-vinyl-2-pyrrolidone/maleic anhydride copolymer on pattern surfaces containing residual release agents. Silica compounds can be added to improve film thickness and to make the coating thixotropic.

The following examples illustrate the advantages of the present invention.

EXAMPLE 1

A foundry core box having considerable resin buildup or residue on the surfaces was used to demonstrate the cleaning ability of the N-vinyl-pyrrolidone/-maleic acid copolymer. The residue on the core box resulted from use therein of a furan resin binder and a sulfur dioxide catalyst. The residue was a hard black coating ranging from 2 to 4 mils thick, which strongly adhered to the box surfaces making core part removal difficult. Cores produced in the said core box were water jacket cores for an internal combustion motor head.

A brush application of an aqueous solution of N-vinyl-pyrrolidone/maleic acid copolymer was applied at a thickness of approximately 20–30 mils. The applied solution was allowed to dry for 2 hours at 70° F. The dried coating solution was blown off with an air hose whereupon over 70% of the resinous residue was removed. A good, clean core box surface was noted where the polymer treating solution had pulled away the black furan-sulfur dioxide residue.

EXAMPLE 2

A wooden pattern for machine housing castings in which a furan no-bake bonded sand was employed was cleaned in accordance with this invention. The wooden pattern had a layer approximately 0.5 to 2 mils thick of residue which was causing poor surface finish and difficult release of the formed part from the pattern surface. A brush application of an aqueous solution of N-vinyl-2-pyrrolidone/maleic acid copolymer was applied approximately 30 mils thick. The cleaning composition was allowed to dry for 2 hours, after which over 90% of the residue was removed by blowing the dried cleaner film away with an air hose.

EXAMPLE 3

A cold rolled steel panel was coated with a thin coating of a furan foundry binder, methyl ethyl ketone peroxide and sulfur dioxide. A 2 to 4 mil thick build-up was achieved which duplicates build-up or residue observed on foundry patterns. N-vinyl-2-pyrrolidone-2-maleic acid copolymer in aqueous solution was brush applied to the steel panel. After drying for four hours at ambient temperature, approximately 90% of the build-up was removed by blasting with an air hose.

EXAMPLE 4

A cast iron tensile core box used for curing hot box tensile core specimens was cleaned with a 25% solution of N-vinyl-2-pyrrolidone/maleic acid cleaning solution. The box contained a film of resin build-up from over two weeks processing. The cleaning solution was sprayed at about 20–30 mils thickness on the core box and allowed to dry. Over 80% of the build-up was removed when the dried coating was blown away with an air hose.

The effectiveness of the N-vinyl-2-pyrrolidone/-maleic acid copolymer in removing cured resin residues from materials is seen from the above. This discovery that N-vinyl-2-pyrrolidone/maleic acid copolymer effectively removes the residue or coating deposited on surfaces as a result of repeated contact with cured resinous materials was completely surprising and unexpected in view of its reported "auto-release" properties with various plastics.

Those modifications and equivalents which fall within the spirit of the invention are to be considered a part thereof. Thus, while the invention is particularly advantageous in the foundry art for cleaning surfaces which have been repeatedly contacted with cured resins, it is broadly applicable for other similar cleaning operations where such residues are deposited on metals.

What is claimed is:

1. A process for cleaning a metal, plastic or wood surface on which there is a build-up of a residue resulting from curing of a resin while said resin is in contact with said surface which comprises:

applying to said metal, plastic or wood surface a solution of a copolymer of N-vinyl-2-pyrrolidone and maleic acid, drying said solution of N-vinyl-2-pyrrolidone and maleic acid to form a film, and separating said film together with said residue from the metal, plastic or wood surface.

2. A process in accordance with claim 1 wherein the build-up of residue results from curing while in contact with said surface a resin binder for sand cores or molds selected from the group consisting of furan no-bake binders, phenolic no-bake binders, phenolic urethane-amine binders, phenolic hot box binders, furan hot box binders, furan-sulfur dioxide binders, acrylic-sulfur dioxide binders, epoxy acrylic-sulfur dioxide binders and alkyd oil binders.

3. A process for cleaning a foundry pattern element on which there is a build-up of a residue resulting from curing a sand binder resin while said resin is in contact with the foundry pattern element which comprises:

applying to said foundry pattern element a solution of a copolymer of N-vinyl-2-pyrrolidone and maleic acid, drying said solution of N-vinyl-2-pyrrolidone and maleic acid to form a film, and separating said film together with said residue from the foundry pattern element.

4. A process in accordance with claim 3 wherein the build-up of residue results from curing a furan or phenolic-urethane sand binder resin while the resin is in contact with said surface.

5. A process in accordance with claim 3 for cleaning a foundry pattern element on which there is a build-up of a residue resulting from curing a mixture of sand and a binder therefor while said mixture is in contact with the foundry pattern element.

6. A process in accordance with claim 3 wherein the foundry pattern element is a metal foundry pattern element.

* * * * *